US007458926B2

(12) United States Patent
Lovaghy

(10) Patent No.: US 7,458,926 B2
(45) Date of Patent: Dec. 2, 2008

(54) QUARTER FOLDER APPARATUS

(76) Inventor: George Lovaghy, 1317 Gaggin Road, Kelowna, British-Columbia (CA) V1X 1V1

( * ) Notice: Subject to any disclaimer, the term of this patent is extended or adjusted under 35 U.S.C. 154(b) by 145 days.

(21) Appl. No.: 11/219,896

(22) Filed: Sep. 6, 2005

(65) Prior Publication Data

US 2007/0066473 A1 Mar. 22, 2007

(51) Int. Cl.
*B31F 1/00* (2006.01)

(52) U.S. Cl. ..... 493/423; 493/441; 493/416; 493/422

(58) Field of Classification Search ..... 493/423, 493/427, 441, 439, 440, 416, 422, 436, 438, 493/417; 271/185, 182
See application file for complete search history.

(56) References Cited

U.S. PATENT DOCUMENTS 3,711,085 A * 1/1973 Bunch, Jr. ..... 493/419
4,747,817 A * 5/1988 Newsome ..... 493/438
4,850,582 A * 7/1989 Newsome ..... 271/185
4,898,373 A * 2/1990 Newsome ..... 270/52.29
5,092,827 A * 3/1992 McAdam et al. ..... 493/179
5,143,368 A * 9/1992 Kiyota et al. ..... 271/202
5,161,792 A * 11/1992 Wood ..... 271/151
5,169,489 A * 12/1992 Kalisiak et al. ..... 156/555
5,800,329 A * 9/1998 Fager et al. ..... 493/417
5,997,459 A * 12/1999 Kruger et al. ..... 493/441
6,371,901 B1 * 4/2002 Jackson et al. ..... 493/405
6,663,552 B1 * 12/2003 Yokoyama ..... 493/441
6,712,748 B2 * 3/2004 Trennepohl ..... 493/423

* cited by examiner

*Primary Examiner*—Sameh H. Tawfik
(74) *Attorney, Agent, or Firm*—Eric Fincham

(57) ABSTRACT

A quarter folder comprising an input conveyer for receiving a shingled stream of half folded signatures, an aligning section for aligning the signatures, a folding section for folding the shingled stream to thereby form a quarter folded shingled stream, a singulating section to separate the shingled signatures into individual folded signatures and a re-shingling section. The quarter folder of the present invention can operate at a high speed and receive copies directly from a press.

17 Claims, 9 Drawing Sheets

QUARTER FOLDER APPARATUS

FIELD OF THE INVENTION

The present invention relates to a folding apparatus and more particularly, relates to a quarter folder for signatures.

BACKGROUND OF THE INVENTION

The folding of paper signatures or like objects is known in the art. Generally, such folders operate at a relatively slow throughput compared to the speed of the press from which the signatures come. In view of this limitation, either the press speed is slowed down to meet that of the folding apparatus or alternatively, a plurality of the folder machines for a single press is required.

Presses conventionally include folding units which bring out multiple sheet single folded assemblies in an overlapped running shingle. The assemblies are called signatures and their folded edges are called spines. The signatures in a running shingle usually move with the spines as the leading edge and with each signature set back slightly from the one which precedes it so that it travels in a shingled relationship. The single folded signature is often called a half folded signature and it often is desirable to fold the same to become a quarter folded signature. By cutting the original spine edge, a quarter folded signature may be turned into a booklet where each page is one-quarter of the original sheet of paper.

Generally, the quarter folding is done on an individual signature. This operation presents an inherent limitation on the speed at which it can be done since each sheet must be individually handled and then quarter-folded.

SUMMARY OF THE INVENTION

It is an object of the present invention to provide a folder for signatures which can operate at a high through-put.

It is a further object of the present invention to provide a mobile inline quarter folder which is able to keep up with the printing speed of a relatively fast web press.

According to one aspect of the present invention, there is provided a folder comprising an input conveyor for receiving a shingled stream of signatures, means for aligning the shingled stream of signatures, means for folding the shingled stream of signatures to form a folded stream of shingled signatures, means for singulating the folded stream of shingled signatures into individual folded signatures, means for re-shingling the individual folded shingled signatures into a stream.

According to a further aspect of the present invention, there is provided a method for folding signatures, the method comprising the steps of providing a line of shingled signatures, aligning the shingled signatures, folding the shingled signatures, singulating the folded shingled signatures and re-shingling the singulated signatures to form shingled folded signatures.

The apparatus of the present invention includes a number of different stations which operate together to provide an inline folder which can operate at high speeds. As utilized herein, the word signatures is used to designate any paper which is to be folded. In a preferred embodiment, the apparatus of the present invention is used as a quarter folder—i.e. it takes an already folded signature and further folds the same. However, it will be understood that the present invention can also be used for performing a half folded signature. The description of the preferred embodiment will generally relate to the quarter folder configuration.

The first station preferably includes a crusher roller which is designed to reinforce the original half fold on the signature as well as to eliminate any air pockets to ensure proper handling of the signature throughout the apparatus. The crusher roller is preferably provided with a quick release for security purposes.

The first station in a preferred embodiment also comes with a drop down air-actuated conveyor which works when a make-ready switch is turned off. In the off position, copies entering the machine are immediately diverted downwards under the machine where they may be placed into a scrap bin or alternatively, fall onto a separate conveyor which carries the product away from the machine. When the pressman is ready to commence the quarter folding operation, the make-ready switch is turned on and copies are immediately allowed to proceed to the subsequent stations. Incorporated with the drop down conveyor are sensors to detect signatures which are sufficiently out of line so as to pose a problem for further processing. When such signatures are detected, the conveyor will immediately drop down.

The second station comprises an aligning station wherein there is provided a high-speed belt jogger which will accurately position the copies entering therein. The jogger includes a slightly elastic belt which is entrained about rollers. At least some of the rollers are of a non-circular configuration so as to provide a vibratory action to the stream of shingled signatures.

In preferred embodiments, a tensioning arrangement is provided for the belting forming the jogger to ensure that the belt as it passes over the non-circular roller is not slipping and provides constant vibration. Furthermore, the rollers for the belt preferably are provided with a double crown arrangement to prevent the belts from derailing.

A third station comprises a section for pinning the signatures and forming the pre-folding configuration. Wings of the paper entering the third section are guided to prevent subsequent problems with the handling of the signatures. In this section, the signatures are formed and folded into the desired configuration and each copy is scored to ensure a clean final fold.

The fourth station is operative to finish the fold which forms the new spine of the signatures. In this regard, spring steel is used immediately after the creasing wheel to ensure a satisfactory fold. The bottom section of the folder is open so that the signature can now move without any friction on the sides which would otherwise create an uneven quarter folded copy.

In the fifth station, the copies are turned through 90° so that they are in a desirable horizontal position for the subsequent operations. The arrangement is such that the subsequent high-speed section does not prematurely pull the copies out ahead of time.

The sixth station is a singulating station which individually separates a stream of signatures in preparation for the re-shingling operation.

The seventh station is a re-shingling operation and provides a catching and braking system which re-shingles each copy to be the same distance apart as when the signatures first entered the apparatus. Preferably, the section also has a drop down conveyor of the type discussed with respect to the first station.

BRIEF DESCRIPTION OF THE DRAWINGS

Having thus generally described the invention, reference will be made to the accompanying drawings illustrating embodiments thereof, in which.

DETAILED DESCRIPTION OF THE INVENTION

Figure 3:
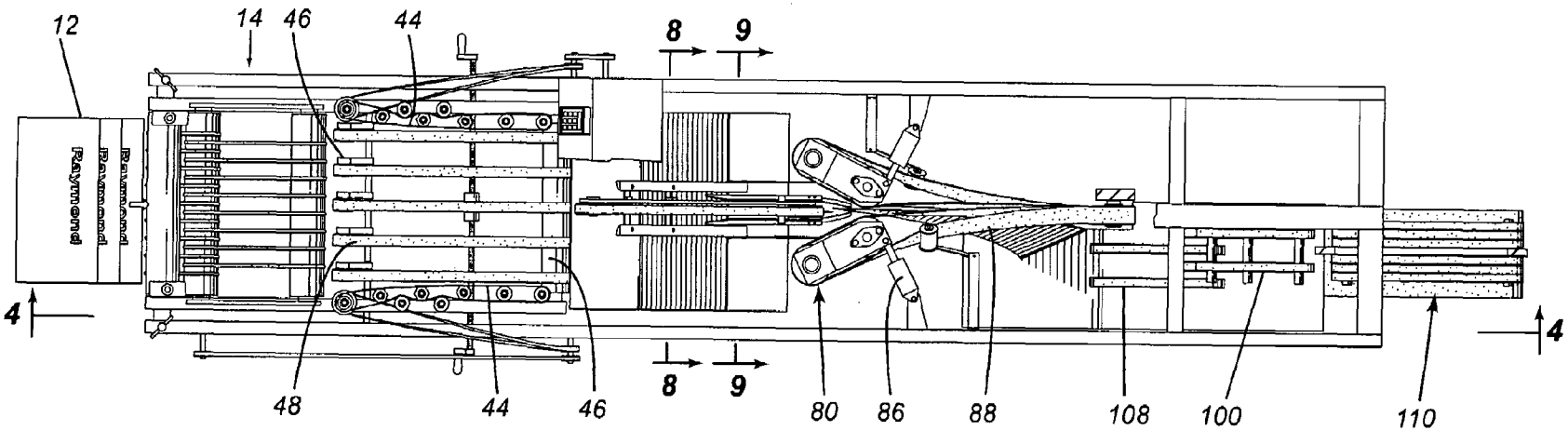
FIG. 3 is a top plan view of the apparatus.
Figure 3A:
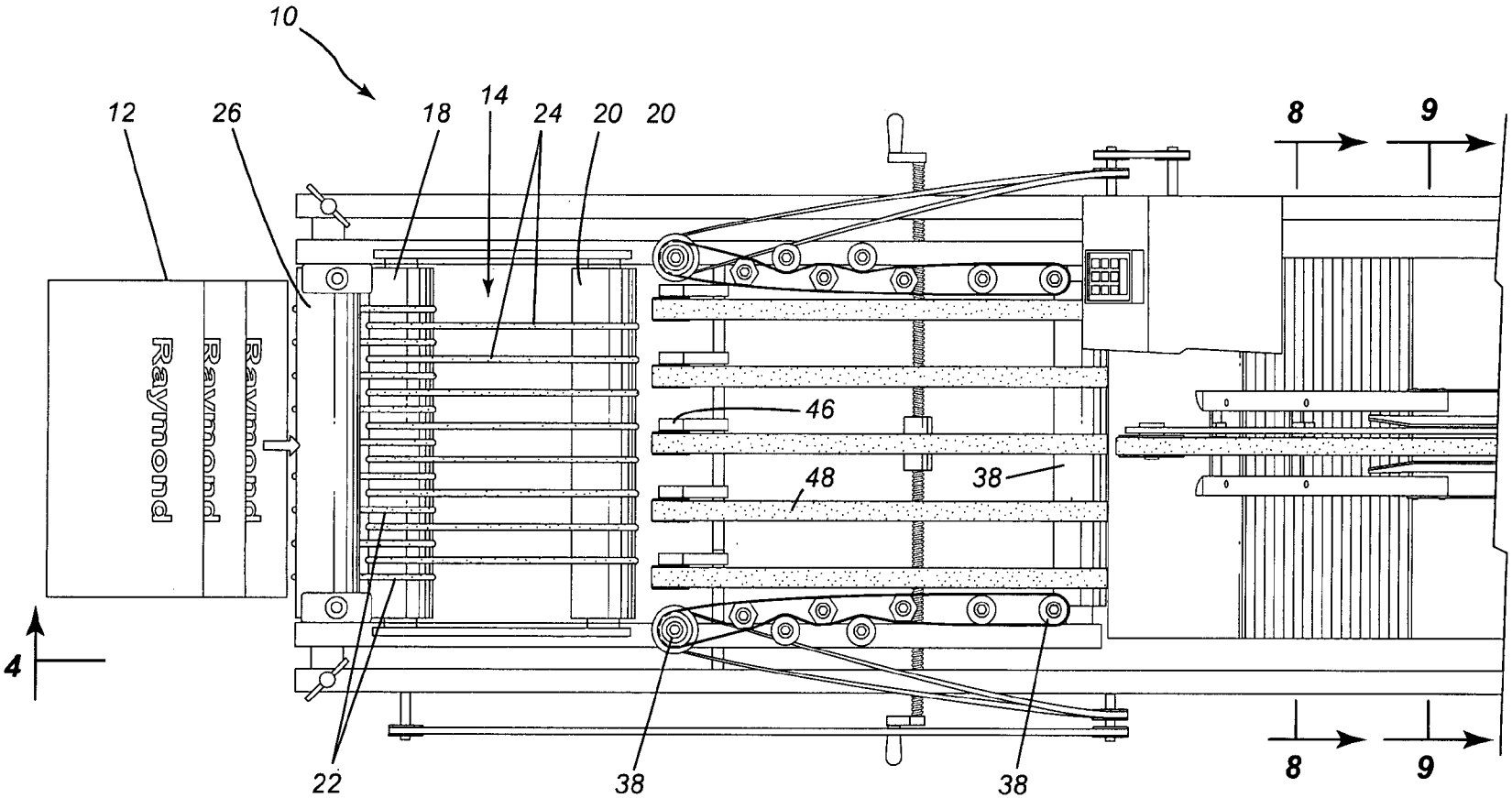
FIGS. 3A and 3B are top plan views of the front and rear portions of FIG. 3.
Figure 3B:
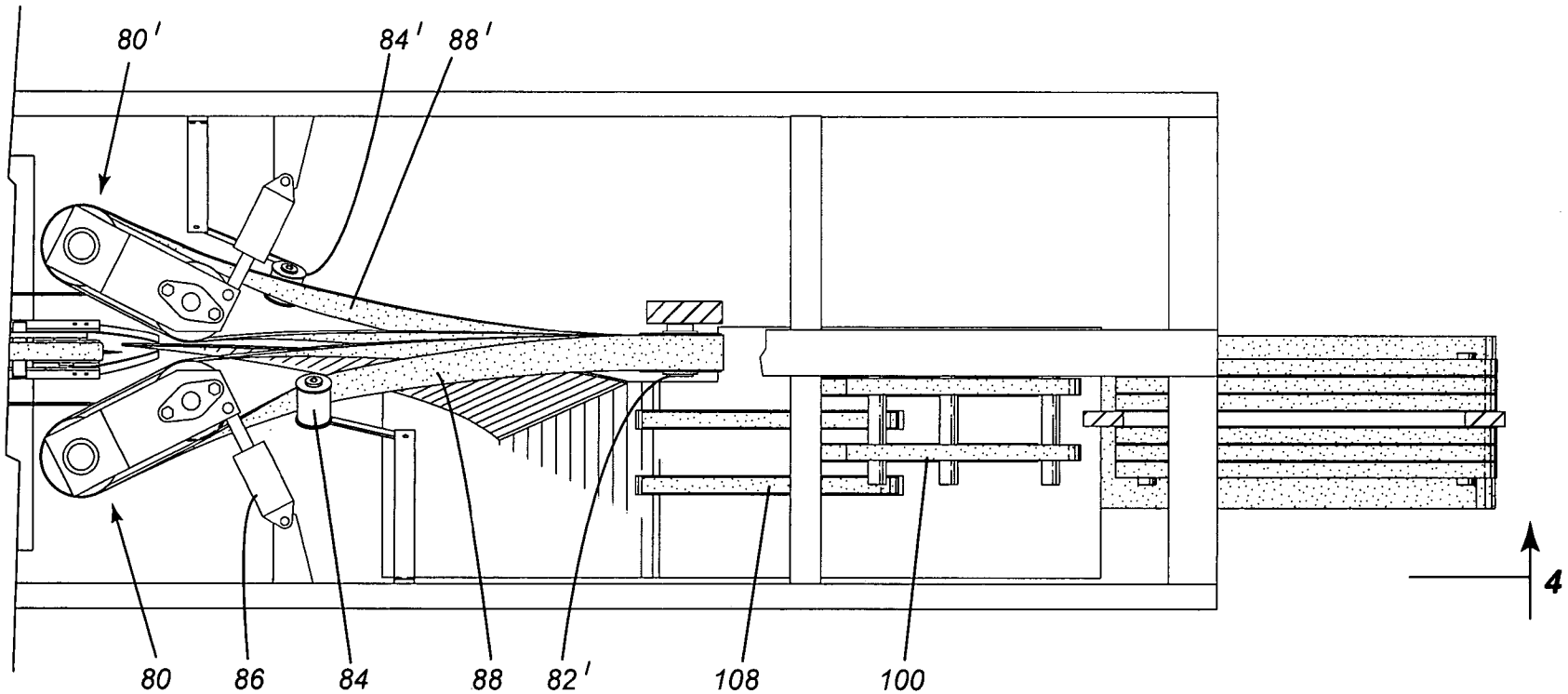

Referring to the drawings in greater detail and by reference characters thereto, there is illustrated in FIG. 3A the first portion of a quarter folder apparatus which is generally designated by reference numeral 10.

Figure 4A:
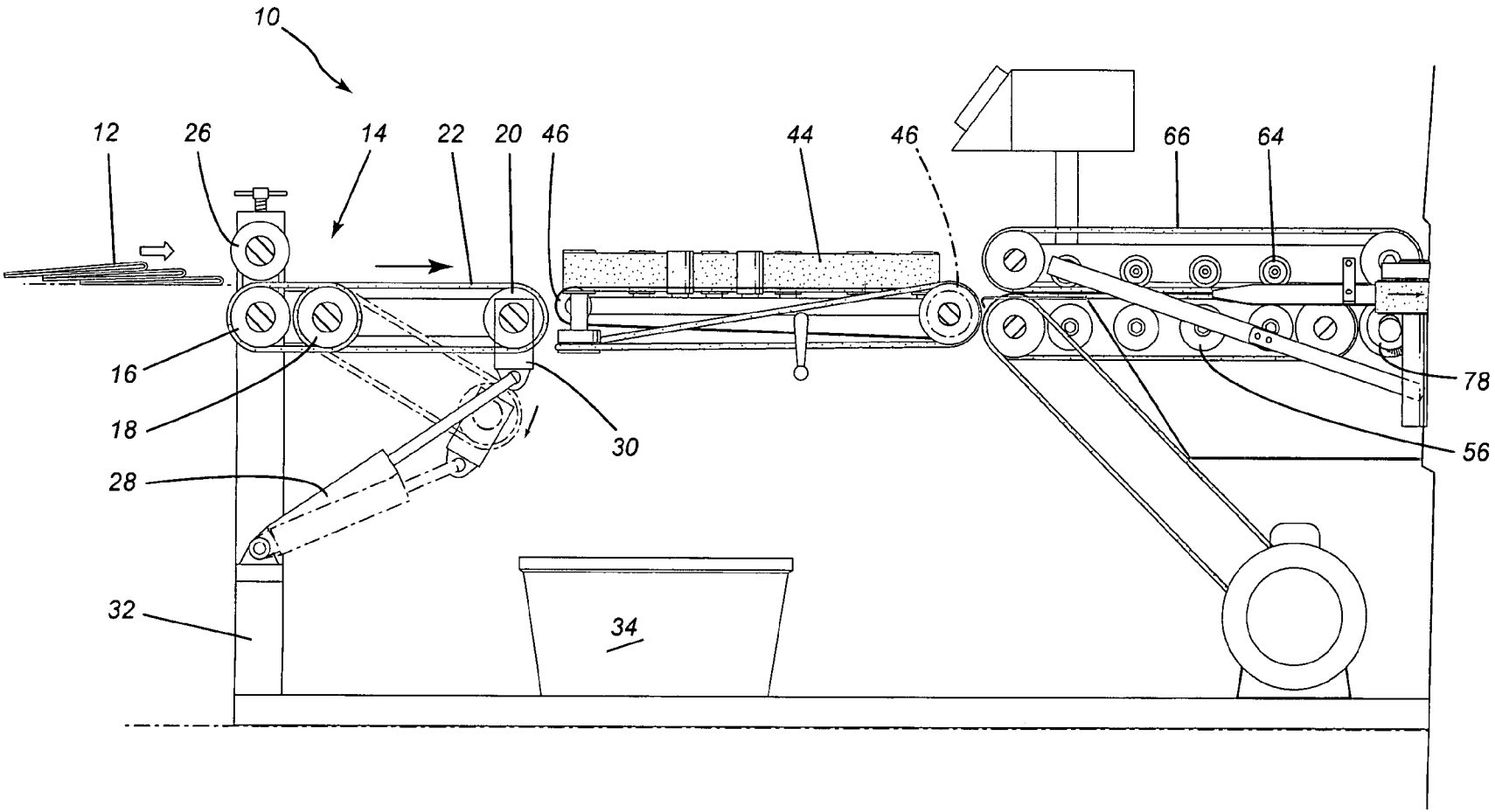
FIGS. 4A and 4B are side elevational views thereof.

Quarter folder apparatus 10 is designed to receive a plurality of half fold signatures 12 coming from any suitable source of the same, including a printing press. Half fold signatures 12 are delivered to a conveyor section generally designated by reference numeral 14 and which conveyor section 14 includes a first roll 16, a second roll 18, and a third roll 20. A plurality of drive belts 22 are entrained about first rolls 16 and 18, with other drive belts 24 being entrained about second roll 18 and third roll 20. Mounted above first roll 16 is a crusher roll 26 which is designed to reinforce the crease forming the spine of half fold signatures 12. As may be seen in FIG. 4A, a pneumatic cylinder 28 is mounted to a frame post 32 and to a bracket 30 on which third roll 20 is journalled. Thus, the conveyor can be moved from a normal operational position to a drop down position (as shown in dotted lines) wherein any signatures there are discharged into a container 34 situated therebelow.

Figure 5:
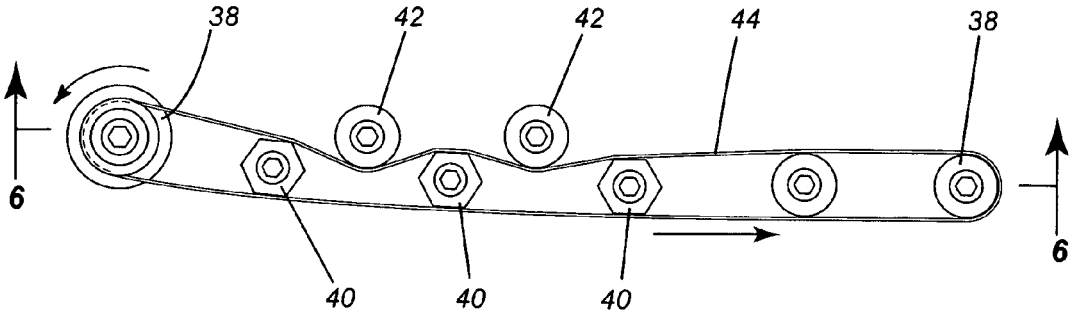
FIG. 5 is a top plan view of one of the belts in a jogger section of the apparatus.
Figure 6:
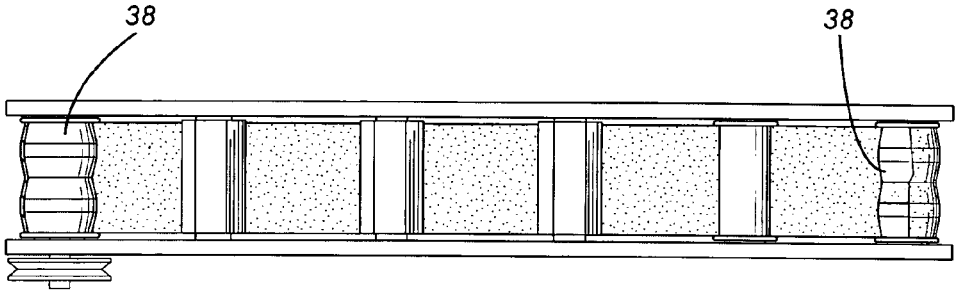
FIG. 6 is a view taken along the lines 6-6 of FIG. 5.
Figure 7:
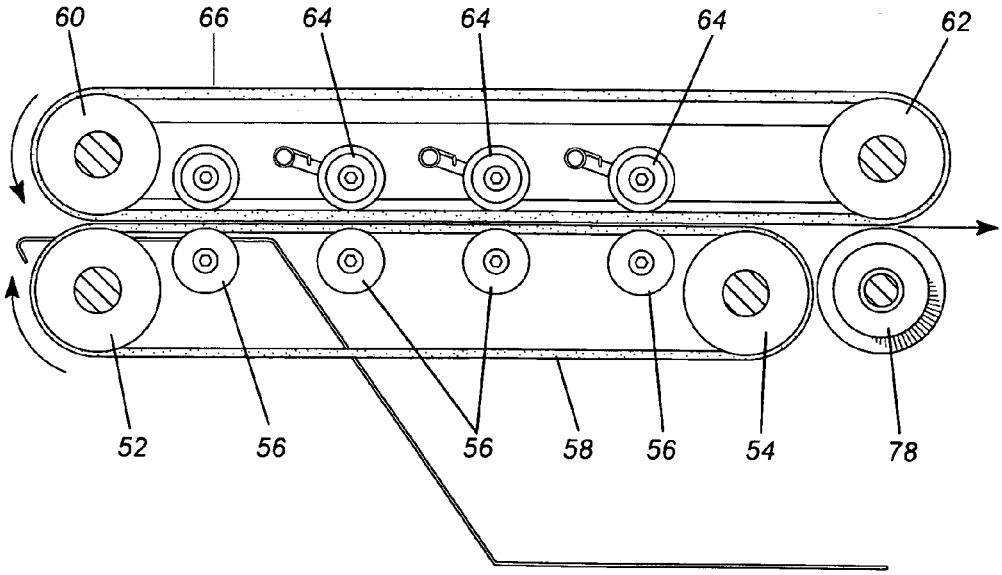
FIG. 7 is a top plan view of the former section of the apparatus.
Figure 8:
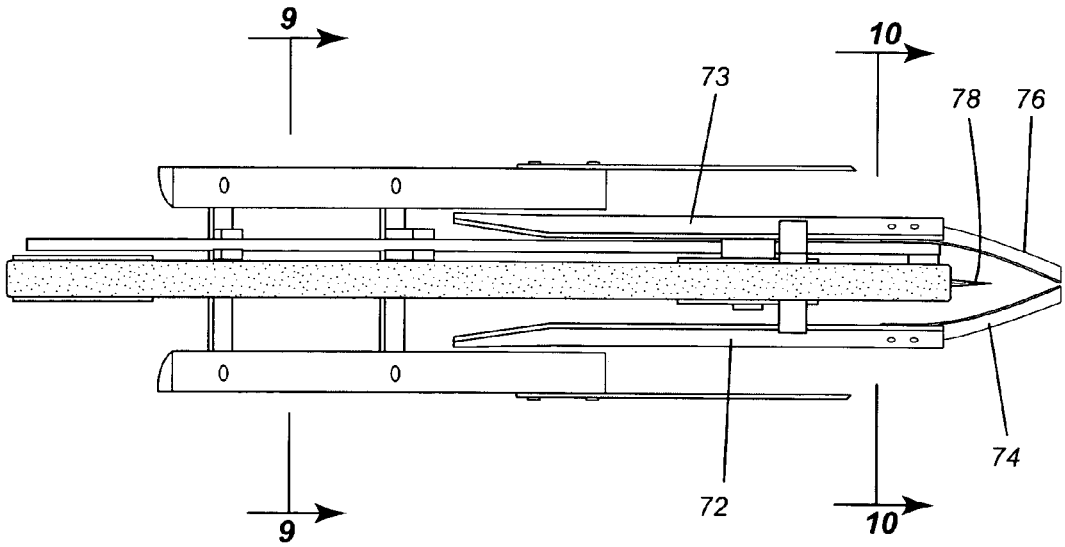
FIG. 8 is a sectional view taken along the lines 8-8 of the FIG. 7.

The subsequent section of apparatus 10 is a jogger section and to which reference will now be had. The jogger includes a plurality of rolls 46 about which belts 48 are entrained. The aligning of the signatures is accomplished by having a pair of end rolls 38 about which a jogger belt 44 is entrained. As will be seen in FIGS. 5 and 6, there is also provided a plurality of hexagonal rolls 40 to impart a vibratory action to jogger belt 44. There are also a plurality of pressure rolls 42 which are designed to maintain pressure on jogger belt 44 such that a good vibratory action is achieved without any slippage of the belt 44. The jogger belts converge in a downstream direction.

Subsequently, the half folded signatures pass to a forming and folding section. In this section, there are provided a pair of lower end rolls 52, 54 about which a small diameter belt 58 is entrained. Between lower end rolls 52, 54 there are also provided a plurality of support rolls 56.

There is also provided a pair of top end rolls 60 and 62 along with a plurality of top support rolls 64 which are pressure adjustable. A relatively narrow top belt 66 is entrained about the rolls.

Figure 9:
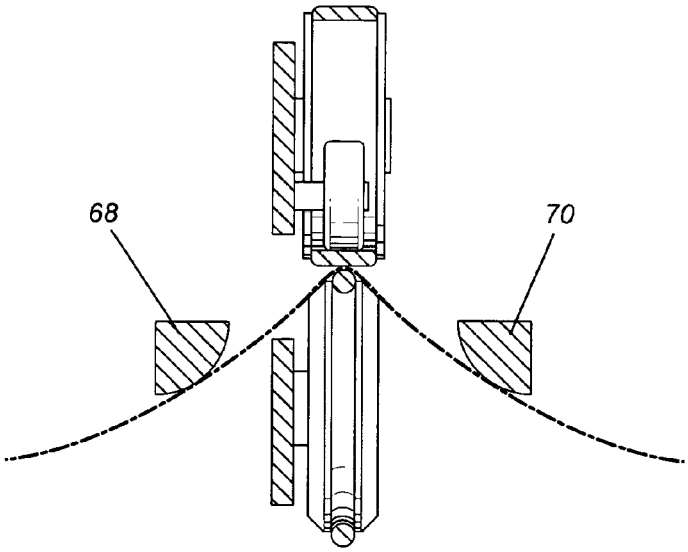
FIG. 9 is a cross sectional view taken along the lines 9-9 of FIG. 7.
Figure 10:
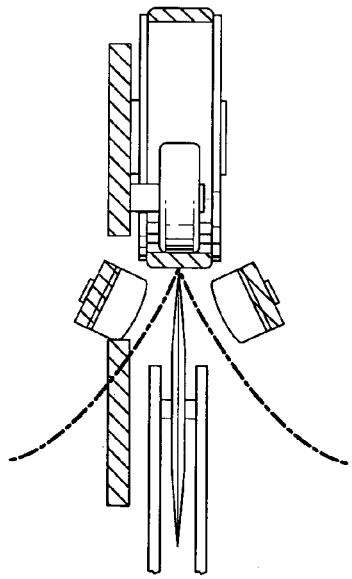
FIG. 10 is a cross sectional view taken along the lines 10-10 of FIG. 7.
Figure 11:
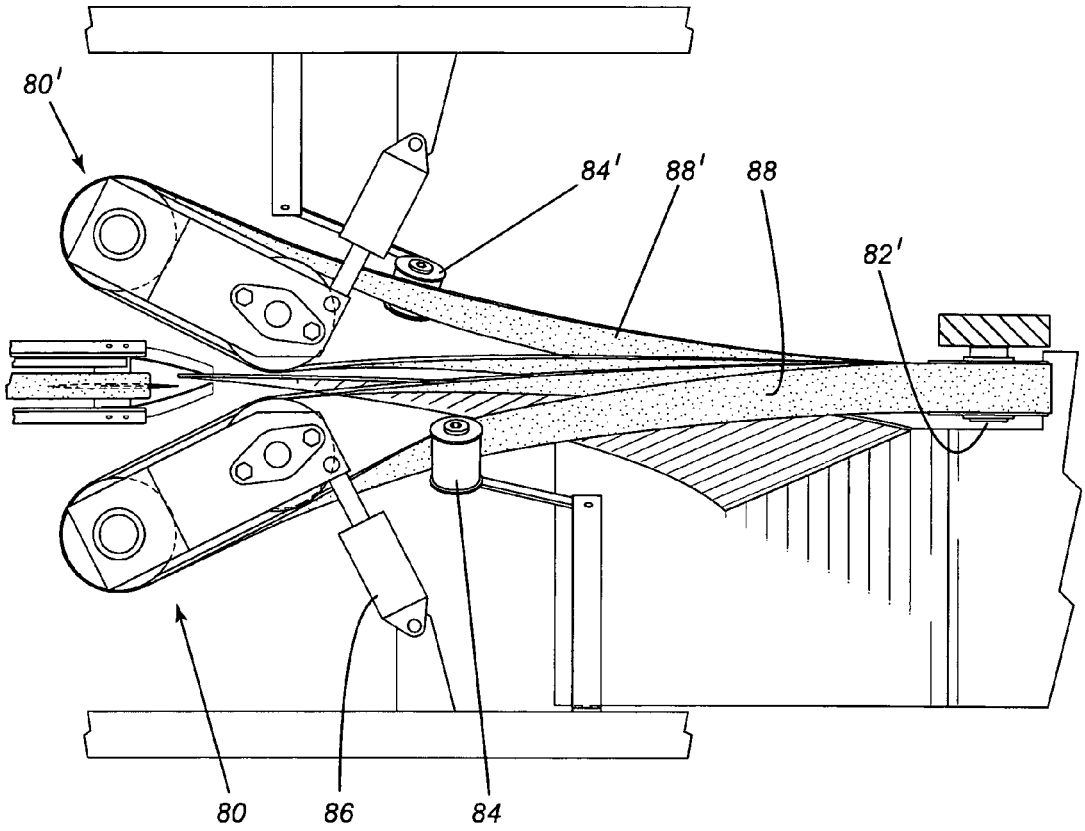
FIG. 11 is an expanded top plan view of the turning of the quarter folded signatures through 90 degrees; and, FIG. 12 is a side elevational view thereof.
Figure 12:
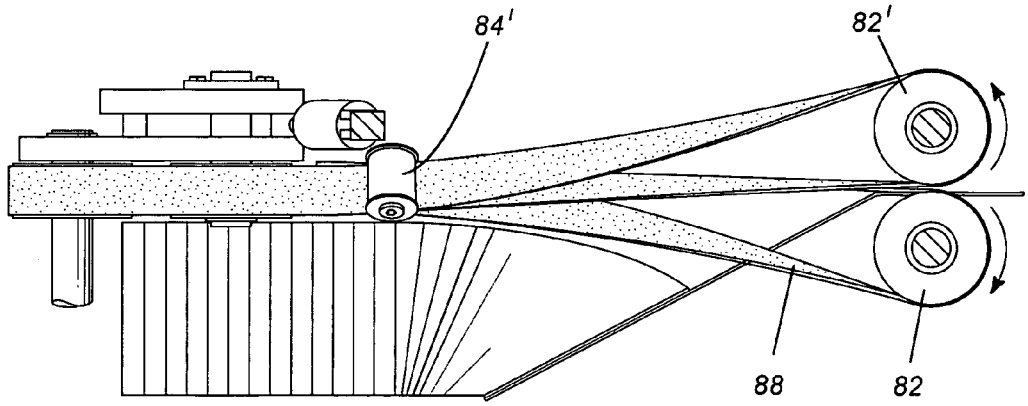

At the entrance to the forming and folding section, there are provided a pair of guide bars 68 and 70 (FIG. 9), one being situated on each side of the apparatus. Each of the guide bars is designed to gently guide the ends of the half folded signatures with the guiding surface being convex in configuration as may be seen in FIG. 9.

Situated further downstream are a second pair of guiding members 72, 73. A pair of spring steel members 74, 76 are arranged to finalize the fold in the signatures. Immediately preceding spring steel members 74, 76 is a creasing roll 78 designed to impart a sharp crease in the signatures. At the next section, there are provided a pair of belt mounting assemblies 80, 80'. A belt 88 is entrained a roll in belt mounting assembly 80 thereabout as well as a roll 82 at the other end thereof. Mounted intermediate the rolls is a guide roller 84. As may be seen in FIG. 3, a pneumatic cylinder 86 is provided for moving belt mounting assembly 80 is provided.

As shown be seen in FIG. 3, belts 88, 88' are twisted such that they take the signatures from a vertical direction to 90° to a horizontal direction. During all this time, the belts maintain a secure grip on the spine of the signatures.

Following the folding operation, the signatures are fed to a singulating mechanism which comprises an upper conveyor 92 and a lower conveyor 102. Upper conveyor 92 comprises a pair of end rolls 94 about which belts 100 are entrained. Mounted centrally between end rolls 94, 96 is a pressure roll 98.

Lower conveyor 102 includes end rolls 104, 106 about which belts 108 are entrained.

The above arrangement is such that as signatures are fed, a nip is created between belts 100, 108 by means of pressure roll 98. This section is running at a substantially higher speed than the previous section and a single signature is withdrawn from the shingled stream. In this regard, the spacing is such that the next signature is securely retained by the preceding section.

Figure 4B:
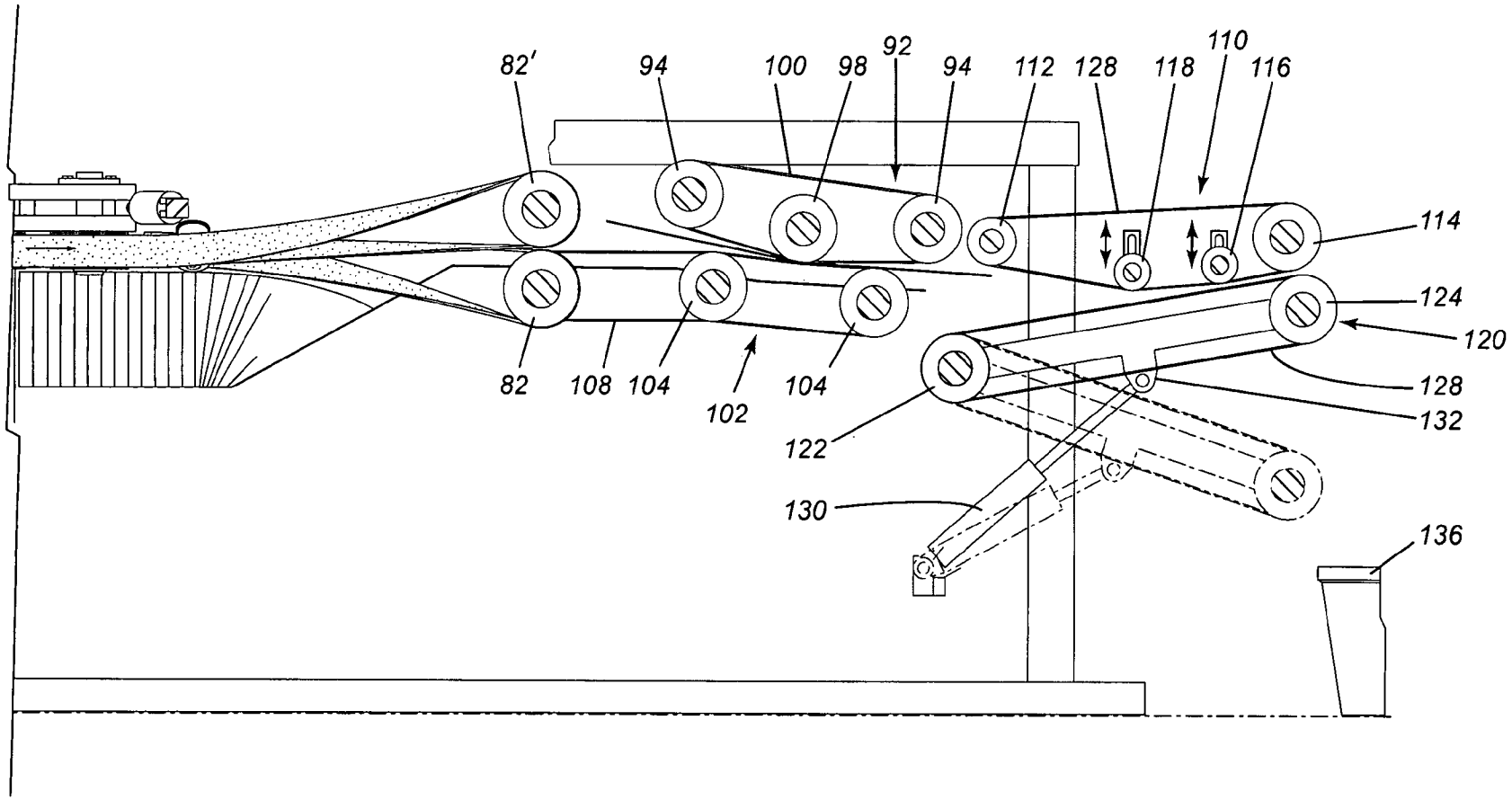

The re-shingling section comprises an upper conveyor 110 which includes a pair of end rolls 112, 114 and adjustable pressure rolls 116, 118 with belts 126 entrained thereabout. A lower conveyor 120 comprises a pair of end rolls 122, 124 having belts 128 entrained thereabout. As may be seen from FIG. 4B, there is also provided a pneumatic cylinder 130 mounted on bracket 132 of the frame and a bracket 134 of lower conveyor 120. Thus, the conveyor can be dropped down or lowered to deposit undesired product in container 136.

As the signatures are travelling at an extremely high rate of speed as they exit the singulating section, the geometry of the upper conveyor 110 and lower conveyor 120 is important. As may be seen, lower conveyor 120 has a slight upward angle while there is a convergence between belts 122, 124 to guide the singulated shingles. Preferably, the lower conveyor is at an angle of between 4° and 6° with respect to the horizontal.

Figure 1:
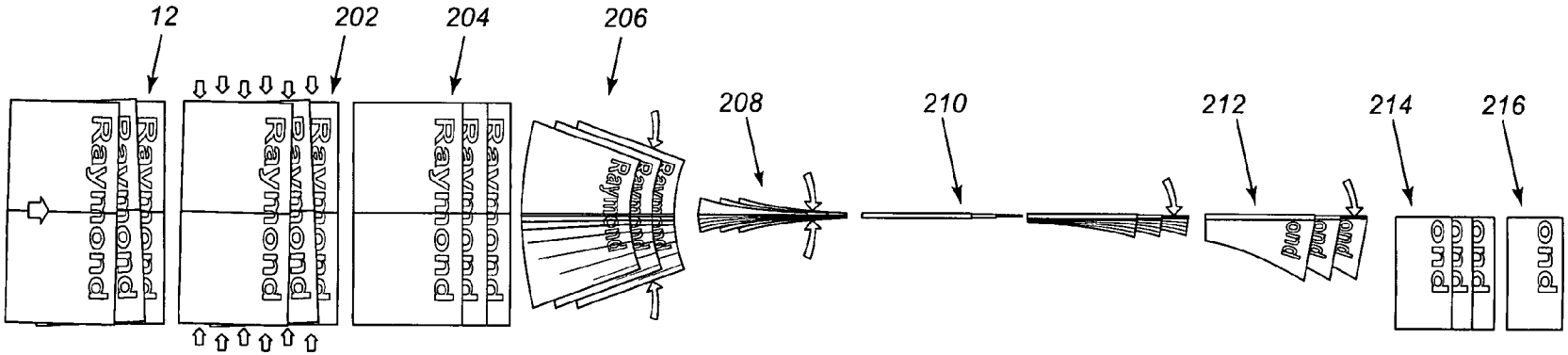
FIG. 1 is a top plan view illustrating the sequence of operation for the transformation of a half fold signature into a quarter fold signature.
Figure 2:
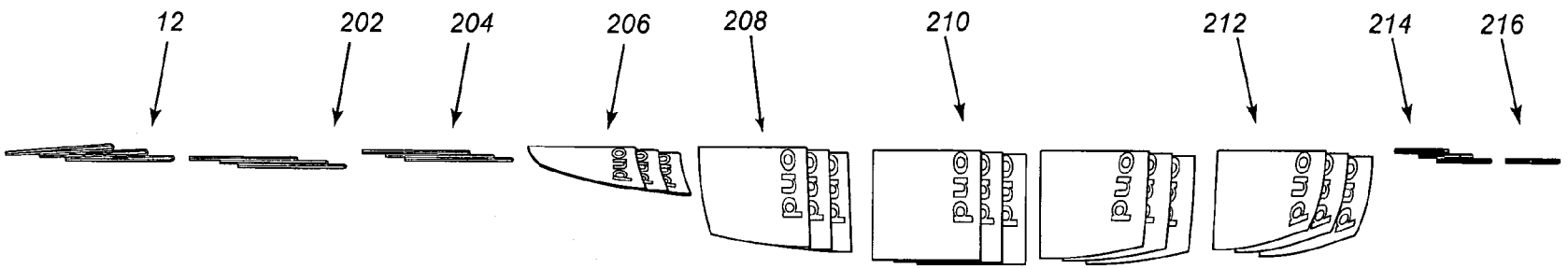
FIG. 2 is a side elevational view thereof.

Referring to FIGS. 1 and 2, the operation of the machine on the signatures is illustrated. As designated by reference numeral 12, originally the signatures enter as half fold signatures and typically slightly misaligned. The signatures then go through the crusher roll and the jogger section as illustrated in reference numeral 202 where they are aligned and flattened. As shown by reference numeral 204, as they exit the aligned or jogging section, they are in a proper shingled position. Subsequently, as indicated by reference numeral 206, the signatures have their wings guided downwardly until, as they pass through the end of the forming section, they are as shown by reference numeral 208 with a final folding being indicated by arrows 210.

As indicated by reference numeral 212, the shingles are then rotated through 90° to lie flat as indicated by reference numeral 214 where they pass to be singulated as indicated by reference numeral 216.

It will be understood that the above described embodiment is for purposes of illustration only and that changes and modifications may be made thereto without departing from the spirit and scope of the invention.

I claim:

1. A folder comprising:

an input conveyor for receiving a shingled stream of signatures;

means for aligning said shingled stream of signatures;

means for folding said shingled stream of signatures to form a folded stream of shingled signatures;

means for singulating said folded stream of signatures into shingled individual folded signatures;

means for re-shingling said individual folded signatures into a shingled stream.

2. The quarter folder of claim 1 wherein said input conveyor comprises a plurality of spaced belts.

3. The folder of claim 2 whereby said conveyor is movable from an operating position to a drop down position wherein any product on a said conveyer is discharged.

4. The folder of claim 3 wherein said conveyer is pneumatically actuated.

5. The folder of claim 1 wherein said means for aligning said shingled product comprises a driven belt on either side of said conveyer, said belts converging in a downstream direction.

6. The folder of claim 5 wherein said belts have vibrating means associated therewith.

7. The folder of claim 6 wherein said vibrating means comprise at least one non circular roller about which said belt is entrained.

8. The folder of claim 7 further including pressure rollers biasing said belt against said non circular roller.

9. The folder of claim 1 wherein said means for folding said shingled signatures comprises an upper belt and a lower belt, said upper and lower belts holding a spine of said half folded signatures, and guide means to guide outer wings of said signatures downwardly.

10. The folder of claim 9 further including score means for scoring said formed product.

11. The folder of claim 10 further including a pair of spring steel members located downstream of said creasing wheel, said spring steel members exerting pressure to complete the fold of said formed signatures.

12. The folder of claim 1 further including means for rotating said product through 90° intermediate of said means for folding and said means for singulating.

13. The folder of claim 12 wherein said means for rotating said product through 90° comprises a pair of twisted belts.

14. The folder of claim 1 wherein said means for re-shingling includes a lower conveyor and an upper conveyor, said lower conveyor being angled with respect to said upper conveyor.

15. The folder of claim 14 wherein said lower conveyor extends upwardly at an angle of between 4° and 6° with respect to the horizontal.

16. The folder of claim 1 further including a crusher roller located proximate to said input conveyor, said crusher roller exerting a pressure on said shingled stream of half folded signatures prior to said means for aligning said shingled signatures.

17. The folder of claim 1 wherein said means for singulating said quarter folded shingled signatures comprises upper and lower belts, said belts being arranged to grasp a spine of an individual quarter folded signature, said upper and lower belts being driven at a speed substantially faster than the speed of the quarter folded shingled signatures.

* * * * *